United States Patent [19]

Brown

[11] 4,300,318

[45] Nov. 17, 1981

[54] CABINET FOR USE IN ABRASIVE BLASTING SYSTEM

[75] Inventor: Donald J. Brown, Naperville, Ill.

[73] Assignee: Knox Manufacturing Co., Wood Dale, Ill.

[21] Appl. No.: 116,011

[22] Filed: Jan. 28, 1980

[51] Int. Cl.[3] ..... B24C 3/04; B24C 9/00

[52] U.S. Cl. ..... 51/425; 51/426; 51/427; 51/319

[58] Field of Search ..... 51/424, 425, 426, 427, 51/319, 320

[56] References Cited

U.S. PATENT DOCUMENTS

| | | | |
|---|---|---|---|
| 760,775 | 5/1904 | Boland | 51/426 |
| 1,601,147 | 9/1926 | Ruemelin | 51/426 |
| 2,777,256 | 1/1957 | Paasche | 51/426 X |
| 3,158,966 | 12/1964 | Mead | 51/426 |
| 3,300,902 | 1/1967 | Dockery | 51/426 |
| 3,352,063 | 11/1967 | Eppler | 51/426 |
| 3,516,205 | 6/1970 | Thomson | 51/426 X |
| 3,545,137 | 12/1970 | Vrana | 51/426 |
| 3,599,375 | 8/1971 | Nunemaker | 51/426 |
| 4,098,033 | 7/1978 | Mann | 51/426 |

*Primary Examiner*—Gary L. Smith

*Attorney, Agent, or Firm*—Wegner, Stellman, McCord, Wood & Dalton

[57] ABSTRACT

A cabinet device is provided for use in combination with an abrasive blasting system. The inner chamber of the cabinet device is maintained at a pressure of less than ambient air pressure during an abrading operation by applying a source of vacuum to an exhaust outlet in the bottom of the cabinet below the article being abraded which is supported on a rack in the chamber. A blasting gun in the chamber is manipulated from outside the cabinet by an operator. An inlet for ambient air is located in the cabinet above the article on the rack and, during an abrading operation, establishes a continuous current of air downwardly toward the cabinet exhaust outlet to clear the space in the cabinet above the rack of view-obscuring debris and dust caused by the blasting operation. An improved sealing device between the cabinet cover and the peripheral sidewall of the cabinet housing is also provided.

8 Claims, 5 Drawing Figures

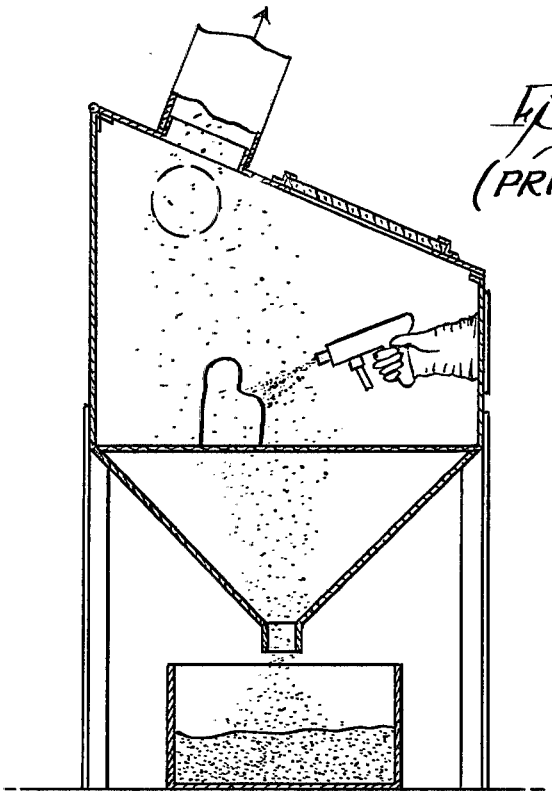
Fig. 1.
(PRIOR ART)
Fig. 2.
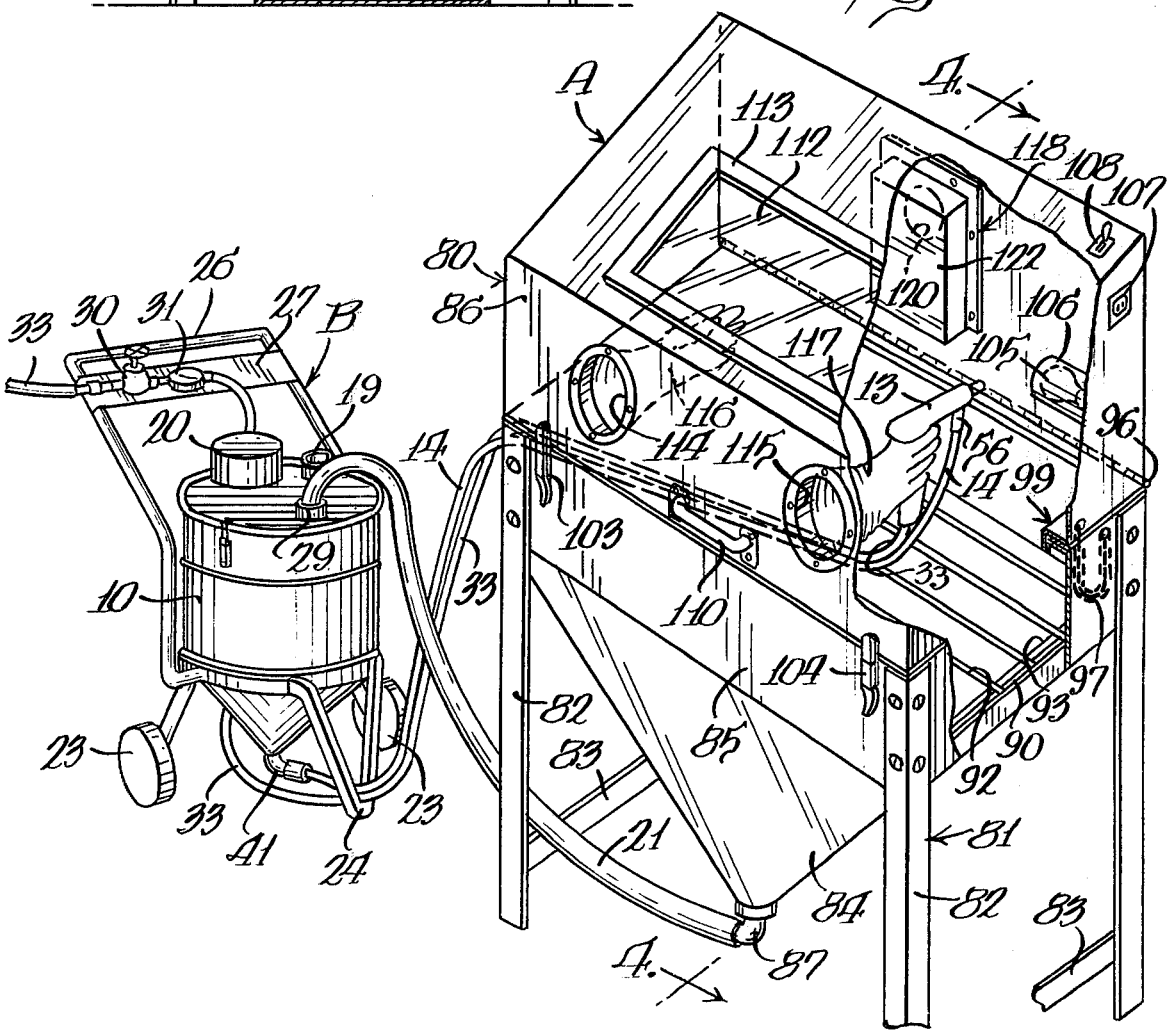

108
86a
86
111
112
113
120
106
118
121
122
86b
117
123
13
52
AIR
54
53
86b
11
5
102
80
16
33
99
88
56
5
AIR
(60PSI)
85
14
GRIT
90
93
92
82
81
84
TO
VAC
& FILTER
21
87
83

CABINET FOR USE IN ABRASIVE BLASTING SYSTEM

BACKGROUND OF THE INVENTION

1. Field of the Invention

This invention relates to an abrading cabinet device for use in an abrasive blasting system utilizing a gun for delivering abrasive material within the cabinet against the surface of an article to be abraded, the cabinet device being constructed and arranged to establish a continuing current of air flow downwardly over the article being worked to continuously clear the space above the article of view-obscuring debris from the abrasive blasting operation.

2. Description of the Prior Art

The structure shown in FIG. 1 is illustrative of an abrading cabinet device which is currently commercially available in the marketplace. The cabinet has four sides formed from pieces of sheet metal which are secured together by bolts and nuts or by machine screws. A funnel-shaped bottom is provided for the cabinet which terminates in a collar affording an opening for a container which collects and receives the abrading material and other heavy materials which fall to the bottom of the cabinet during an abrading operation. The cabinet is generally supported by four leg members. A cover member is swingably mounted on the cabinet by a hinge member, and the cover member has a transparent window mounted in its surface so that an operator can view the abrading operation within the cabinet chamber. A rack or grid is generally provided adjacent the top of the funnel-shaped bottom of the cabinet to support the article or work upon which the abrading operation is to be performed. A pair of flexible glove members project through openings in a sidewall at the front of the cabinet and each is secured to its respective opening to provide access for the hands of an operator to operate the gun and to manipulate the article supported on the rack or grid. The gun is conventional. A first hose line is connected to the gun and delivers pressurized air from an external compressor to the gun. A second hose line is also connected to the gun and delivers an abrading material to the gun from an external source so that a rapidly-moving stream of abrading material is delivered from the gun by the pressurized air upon the article supported on the rack.

An exhaust opening is provided in the cover or in the upper portion of one of the sidewalls. A flexible conduit is generally secured to the exhaust opening to lead the dust and airborne debris from the inner chamber of the cabinet. A vacuum is sometimes applied to the exhaust conduit to move the dust and debris to a location remote from the cabinet. The device is environmentally unsound because it produces a great deal of dust and contaminants in the atmosphere exterior of the cabinet. Because of pressurized air from the blasting gun the interior of the cabinet is at a pressure greater than one atmosphere. Furthermore, air flow in the cabinet carries dust and debris upwardly of the cabinet over the article being worked to hinder the view of the operator conducting the abrasive blasting operation.

Another device of which the inventor is aware is shown in U.S. Pat. No. 3,599,375. Again, the exhaust of dust and airborne debris from the abrading operation is at a position in the sidewall of the cabinet above the grid or rack supporting the article worked upon so that the path of the dust and debris continuously obscures the article worked upon during an abrading operation. Furthermore, just as in the prior art device previously described, the air pressure in the cabinet during an abrading operation is at a pressure higher than ambient atmospheric pressure. Thus the stream of air set up within the cabinet, and carrying the dust and air-laden debris, obscures the operator's view of the article being abraded during a blasting operation.

SUMMARY OF THE INVENTION

It is the principal object of the present invention to provide an improved abrading cabinet device for use in an abrasive blasting system which provides for maintaining the interior of the cabinet device at a pressure of less than one atmosphere so that ambient air introduced into the cabinet above the article being worked will establish a continuing current of air flow downwardly during a blasting operation to continuously clear the space above the article of view-obscuring debris from the blasting operation.

Another object includes providing a cabinet device adapted to be used with an abrading device which will collect and recycle the abrasive material being used in the cabinet device.

A further object is to provide an abrading cabinet device for use with an abrading device which will exhaust air-laden dust and debris and filter the same so that such dust and debris will not be introduced into the surrounding atmosphere.

Still another object is to provide an improved sealing structure between the cover and the peripheral sidewalls of the cabinet which will shield the sealing member from the rapidly moving and ricocheting particles of abrasive material.

Yet another object is to provide an improved abrading cabinet device in which the means for manipulating the blasting gun in the cabinet is positioned in the cover of the cabinet so that articles in all locations within the cabinet can be subjected to the blasting operation.

In an exemplary embodiment of the invention, the cabinet device has a cabinet housing formed from a funnel-shaped bottom, a peripheral sidewall and a cover member to afford an inner blasting chamber. The housing bottom terminates in an exhaust outlet. A rack is positioned above the exhaust outlet in the chamber for supporting articles to be abraded. The rack is formed of spaced elements to permit spent abrasive and debris from a blasting operation to fall downwardly through the rack toward the exhaust outlet. An inlet for ambient air is provided in the cabinet at a position above the rack. When the exhaust outlet is connected to a source of vacuum exteriorly of the cabinet, the interior of the cabinet is maintained at a pressure of less than one atmosphere. Thus, entering ambient air establishes a continuing current of air flow downwardly through the rack and through the exhaust outlet in the housing bottom to clear the space in the cabinet above the article being abraded of view-obscuring debris from the blasting operation.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 1 is a sectional view illustrating the structure of a prior art cabinet device commercially available in the marketplace;

FIG. 2 is a perspective view with certain portions of the cabinet device broken away to illustrate internal structure, and showing the cabinet device connected in operable relation with an external abrading device;

DESCRIPTION OF THE PREFERRED EMBODIMENT

Figure 3:
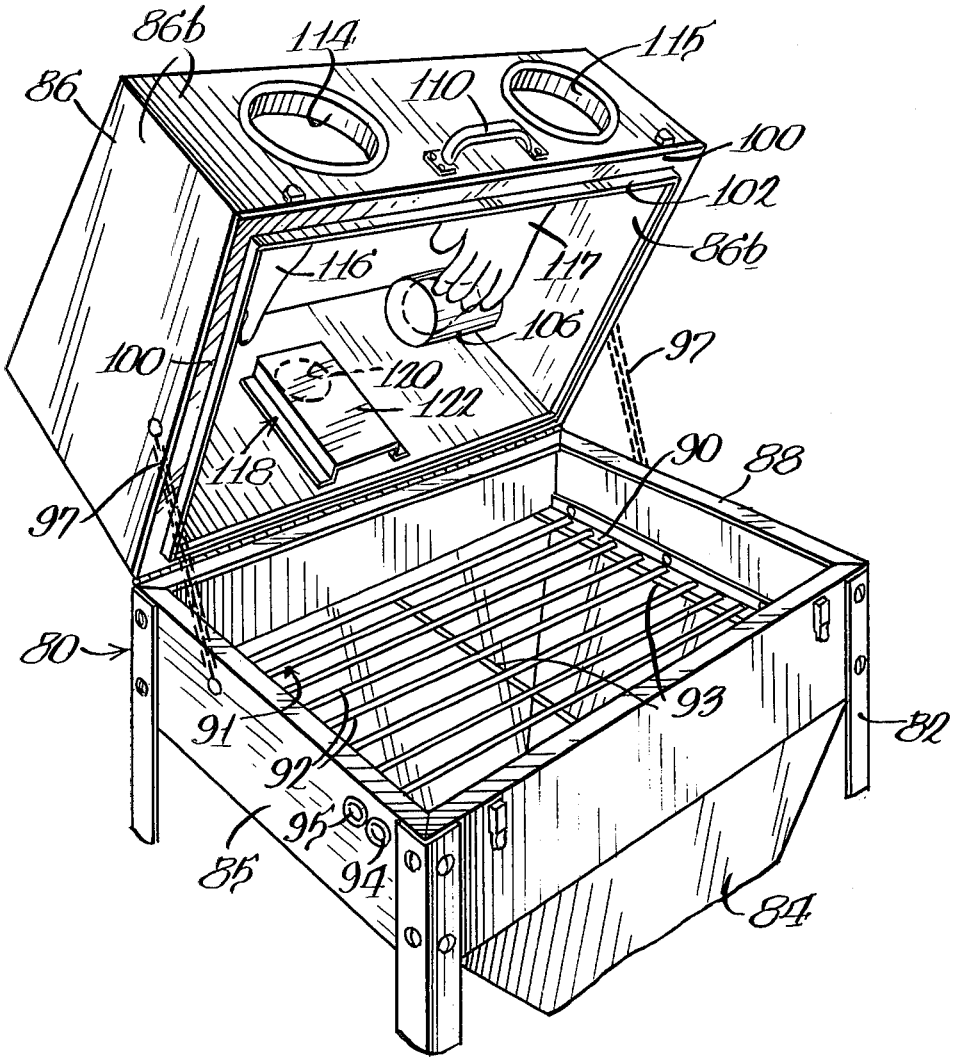
FIG. 3 is a perspective view of the cabinet device with the cover member swung to open position and with a portion of the funnel-shaped bottom and leg members broken away.

Referring to FIG. 2, an abrading cabinet device, generally designated A, is operably connected and arranged in conjunction with an abrading device, generally designated B. The abrading device B has the structure as shown in my copending application Ser. No. 909,537 entitled "Abrading Device" filed May 25, 1978, now U.S. Pat. No. 4,232,487, and the disclosure of this copending application is expressly incorporated herein and expressly made a part of the instant disclosure.

The abrading device B generally includes a housing or canister 10 which provides an internal reservoir for abrasive material (such as sand, garnet granules, glass beads or the like). A gun 13 propels abrasive material against a work surface 16, the abrasive material being delivered through a supply conduit 14. A vacuum motor 20 withdraws abrasive material from the bottom of the cabinet A through a retrieval conduit 21 so that spent abrasive material and other debris from the abrading operation is returned to the interior of the canister 10.

The housing or canister 10 is supported by a frame which includes a pair of rear wheels 23, a front leg 24 and a rearwardly extending U-shaped handle 26. A pressure regulating valve 30 and a pressure gauge 31 are mounted on a cross member 27 and are connected into a pressurized air conduit line 33. The valve 30 is adjustable to vary the velocity of the pressurized air (and hence the pressure of the air) in the conduit line 33. The upstream end of the air conduit 33 is joined by way of a quick disconnect nipple and connector coupling to an external air supply or compressor providing air under high pressure.

The bottom of the canister 10 is preferably hopper-shaped to funnel abrasive downwardly from within the canister toward an outlet 41 which is connected to the abrasive supply conduit 14.

The gun 13 has a passageway 52 which extends through its hand grip 53 and its barrel 54. The downstream end of the air pressure hose 33 is connected to the hand grip end of the passageway 52, and the downstream end of the abrasive supply line 14 is connected to inlet tube 56 which empties into the forward portion of the passageway 52.

The vacuum motor 20 is mounted on the canister lid which seals the top of the canister 10 and may be removed therefrom by releasing the lock members provided. The abrasive retrieval line 21 is detachably connected to the canister 10 by inserting its downstream end into an inlet tube 29 extending through the lid of the canister. The vacuum motor 20 drives a fan element which draws air from the interior of the canister 10 through a removable filter bag and exhausts the air externally through an outlet 19 in the lid of the canister. Thus the interior of the canister above the abrasive is evacuated so that the pressure therein is substantially less than atmospheric pressure. Consequently, the spent abrasive and debris from the cabinet A will be drawn through the retrieval line 21 and deposited into the canister 10. Dust and airborne debris which is carried by the retrieval line 21 to the canister 10 will be filtered out by the filter element which internally covers the air passageway leading to the air outlet 19 in the lid of the canister 10.

Thus in operation the abrading device B and the abrading cabinet device A establish a complete circuit for flow of abrasive material from the reservoir within the canister, to the blasting gun, to the work surface within the cabinet A, from the work surface to the bottom of cabinet A, and then through the retrieval line 21 back to the interior of the canister 10. Importantly, the cabinet device is arranged in its structure and function so that it can be used in an enclosed shop without the necessity of a special discharge line to the exterior air outside of the shop.

The abrading cabinet device A includes a cabinet housing generally designated 80 and a base member generally designated 81 for supporting the cabinet device in upright position. The base member preferably includes a plurality of metal leg members 82 provided with reinforcing metal braces 83.

Figure 4:
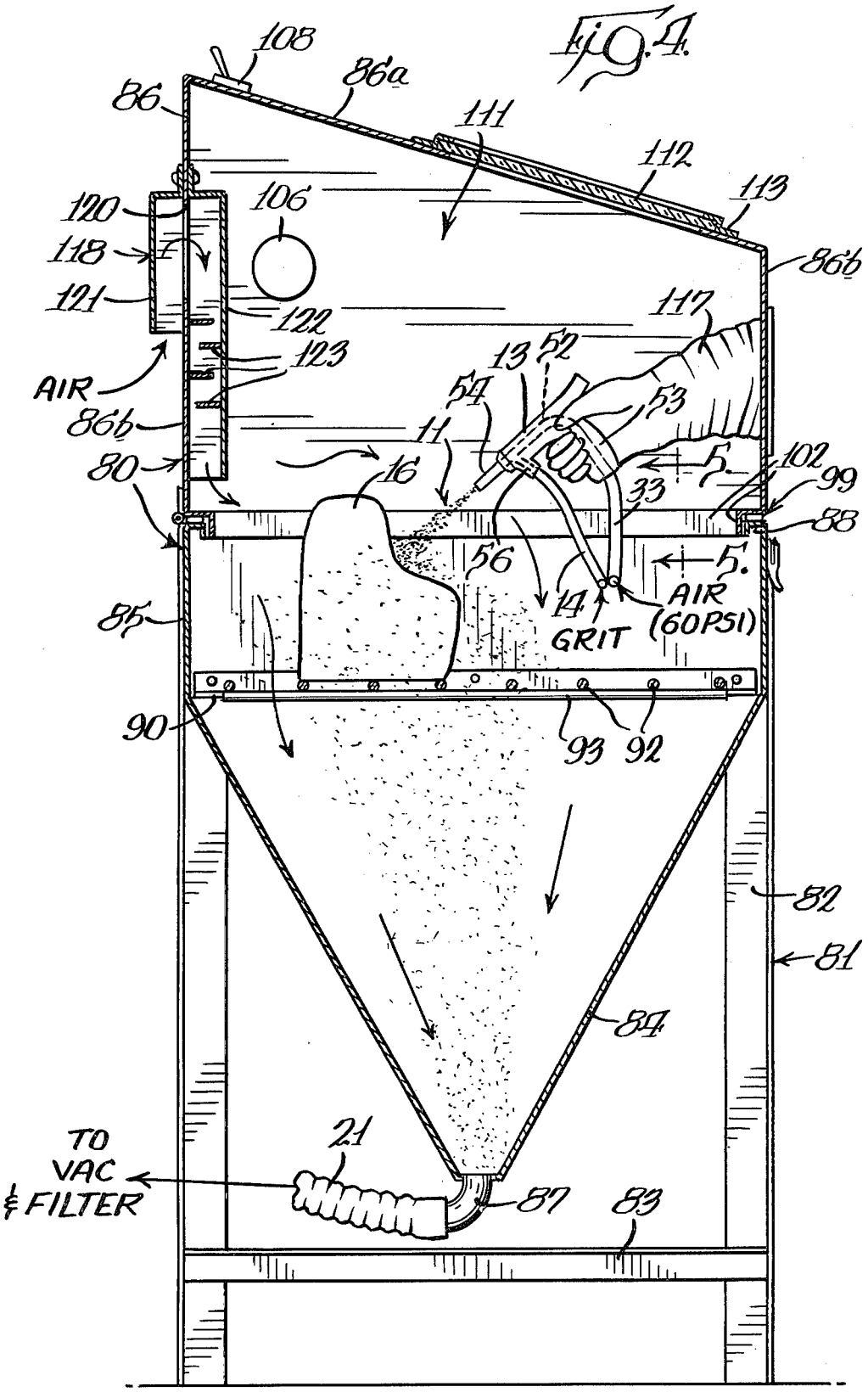
FIG. 4 is a sectional view taken as indicated on line 4—4 of FIG. 2.

The cabinet housing 80 includes a housing bottom 84, a peripheral sidewall 85 and a cover member 86, all formed of a medium to heavy gauge sheet metal steel of abrasive resistant properties. The housing bottom is funnel-shaped or hopper-shaped, as best shown in FIG. 4, and it is preferably integrally formed with a peripheral sidewall 85 by appropriate bends in the sheet metal, or by spot welding. The leg members 82 are in turn preferably spot welded at each corner of the peripheral sidewall 85. An exhaust outlet 87 is provided at the lower end of the funnel-shaped bottom 84, and the exhaust outlet 87 may be made in the form of an L-shaped connector to accommodate in air-tight fashion an end of the abrasive retrieval line 21. It is understood that the retrieval line 21 carries back to the abrading device B not only the abrasive material 11 but also the material removed in the surface treatment of the work, the dust and other air-laden debris, which is shown in movement in FIG. 4 from the work 16 toward the exhaust outlet 87.

The peripheral housing sidewall 85 is provided at its upper portion with a circumferentially extending, inwardly turned portion which affords an exposed surface 88 for sealing engagement with the cover member 86 as will be subsequently explained. The inner wall of the peripheral sidewall 85 may be provided with a pair of oppositely disposed ledges 90 which are secured thereto in the conventional manner as by spot welding. A rack generally designated 91 is formed of spaced elongated members 92 secured in position by spaced cross braces 93. The rack 91 simply rests upon the ledges 90 and provides a support for the work 16 within the cabinet device A. As best seen in FIG. 4, the rack 91 rests above the funnel-shaped bottom 84 and is spaced a substantial distance from the exhaust outlet 87. The cabinet housing peripheral sidewall is preferably provided with a grommet lined aperture 94 to accommodate the abrasive supply line 14 in a substantially air-tight manner and with a grommet lined aperture 95 to accommodate the air pressure line 33 in a substantially air-tight manner, both of which are connected to the gun 13 in the manner previously described.

The cover member 86, formed of a medium to heavy gauge sheet metal steel (for example 20 gauge) is preferably movably and swingably mounted to the housing peripheral sidewall 85 by a conventional piano-type hinge 96. As shown in FIG. 3, restraining chains 97 are provided between the peripheral sidewall and the cover to limit the swinging movement of the cover 96 to its open position. In its open position, articles being worked upon can be inserted or removed from the cabinet.

The cover member 86 includes a top 86*a* and a depending peripheral sidewall 86*b* which terminates in a circumferentially extending sealing means generally designated 99. The sealing means 99 includes an inwardly turned circumferentially extending seat 98 which has a resilient seal member 100 adhered to its lower surface as at 101 in FIG. 5. The seal member 100 rests upon the inturned surface 88 of the housing peripheral sidewall 85 to form an effective air-tight seal between the cover member 86 and the peripheral sidewall 85.

Figure 5:
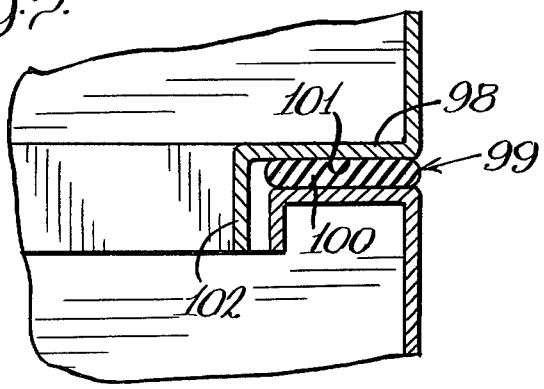
FIG. 5 is a broken, enlarged sectional view taken as indicated on line 5—5 of FIG. 4 and showing the arrangement of the sealing structure between the cover and the peripheral sidewall wall of the cabinet.

Means are also provided in relation to the seat or cover edge portion 98 and the resilient seal 100 to protect the seal member 100 from the action of the rapidly moving and ricocheting abrasive material 11 during a blasting operation. To this end, a circumferentially extending depending portion 102 is provided which extends downwardly past the sealing member 100, as shown in FIG. 5, to protect the sealing member 100 against abrading action of the abrasive material during the blasting operation.

As best shown in FIGS. 2 and 3, conventional latches 103 and 104 cooperate between the cover member 86 and the housing peripheral sidewall 85 to releasably hold the cover member in sealing engagement with the surface 88 of the sidewall 85.

A means of illumination is secured interiorly of the cover depending sidewall 86*b* and is provided with an appropriate surrounding shield 106. A receptacle 107 for an electrical plug is also mounted in sidewall 86*b*, as shown in FIG. 2, and this plug is electrically connected to a switch 108 in the cover and to the illuminating means 105.

A handle member 110 may be secured to the cover member 86 to facilitate moving the cover between open and closed positions.

It should also be noted that the depending sidewalls 86*b* of the cover member 86 cooperate with the housing peripheral sidewalls 85 to form an enlarged inner blasting chamber 111 for accommodating articles of substantial size. The cabinet herein shown is approximately 30" long, 20" wide, and 24" high at its back wall.

The top 86*a* of the cover member 86 is preferably generally slanted toward the forward or operator's side of the cabinet device. Preferably, the top member 86*a* is provided with a window 112 of transparent material which is held in place by a rectangular frame 113 secured to the top member 86*a* of the cover 86. The window is of sufficient length and width to permit an operator to view an article supported on the rack 91 no matter the location of the article on the rack. The window 112 must also be of such size and of such material as to withstand the external pressures thereon when the air pressure within the internal chamber 111 is reduced below one atmosphere.

At the front of the cabinet device A, preferably high in the front depending sidewall 86*b*, a pair of openings 114 and 115 are provided. Glove-like elements 116 and 117 are positioned in each of the openings 114 and 115, and each of the glove-like elements is hermetically sealed within its respective opening in air-tight fashion. The glove means 116 provides a means for manipulating the gun 13 from a position exteriorly of the cabinet housing by an operator during a blasting operation. Similarly, the glove-like element 117 provides a means for manipulating articles to be abraded within the chamber 111 by an operator from a position exteriorly of the housing. The stream of abrasive material 11 from the gun 13 can be directed to all portions of the rack 91 by an operator viewing the article to be abraded through the transparent window 112.

However, the view of an operator in conventional cabinets of this general type is frequently obscured by ricoheting abrasive material, by particles being removed from the article or work being abraded (some airborne and some not), and by dust and debris as a result of the abrading operation, all of which lodge from some period of time in the space in chamber 111 between the rack supporting the work and the window through which the work is observed by the operator conducting the blasting operation. In addition, all of the abrading cabinet devices of which I am aware insert into the chamber of the cabinet sufficient pressurized air from the gun 13 as to keep the pressure within the cabinet slightly greater than one atmosphere and slightly greater than ambient air pressure. Thus air-laden dust and debris is carried outwardly of the cabinet device above the supporting rack or grid so as to obscure the vision of the operator through the window to the article being abraded.

In the structure provided herein, an inlet means generally designated 118 is provided to permit the ingress of ambient air into the chamber 111 of the cabinet housing at a position substantially above the rack during a blasting operation to establish a continuing current of air flow downwardly through the rack and past the work and through the exhaust outlet in the housing bottom, the air flow being indicated generally by the directional arrows shown in FIG. 4. This continuing current of air continuously clears the space in the chamber between the window and the work on the rack so that view-obscuring dust and debris from the blasting operation is carried to the exhaust outlet 87 and permits the operator to continuously view the work on the rack 91 upon which the operator is carrying out a blasting operation with the gun 13. This clearing of dust from above the work 16 occurs because the air pressure in the cabinet 111 is reduced below one atmosphere or ambient air pressure by the source of vacuum from the abrading device B connected to the exhaust outlet 87 through the abrasive and debris retrieval line 21.

The inlet means 118 includes an opening 120 in the back depending sidewall 86*b* of the cover member 86. An inverted U-shaped passage for ambient air, as best seen in FIG. 4, is provided by the U-shaped rear aperture shield 121 (closed at its upper end) and secured to the rear sidewall 86*b* by spot welding or mechanical means, and by a U-shaped inner shield 122 (closed at its upper end) and also covering aperture 120. Inner shield 122 also is secured to the back sidewall 86*b* by spot welding or by mechanical means, and inner shield 122 preferably extends downwardly a substantial distance more than outer shield 121. Small apertures may be provided in the lower end of inner shield 122 below the lower extremity of the aperture 120. In addition, it is preferred that baffles 123 be provided across the portion of the passageway formed by the inner U-shaped shield 122 so that ricocheting abrasive material and debris or flakes from the article being worked will not escape outwardly of the chamber 111 of the cabinet.

Thus during an abrading blasting operation, when a source of vacuum is applied to exhaust outlet 87 to create a negative pressure (or pressure less than one atmosphere or ambient pressure) within the chamber 111, ambient air enters the chamber 111 through the inlet means 118 because of the pressure differential and thus entering ambient air flows in a continuous stream or current downwardly through the rack, and past the work, to and through the exhaust outlet and through retrieval conduit 21 to the source of vacuum being applied. The source of vacuum and this continuous current of air continuously clears the space in the chamber 111 above the work 16 and the rack 91 of view-obscuring dust and debris from the blasting operation by carrying said dust and debris to the exhaust outlet so that the view of the operator through the window 112 of the work 16 is not hindered and is greatly facilitated.

As explained above, in addition to the dust, the debris, and the large particles dislodged from the work 16, the abrasive material is also carried back through the retrieval conduit 21 to the canister 10 of the abrading device B for subsequent cyclic re-use. When the airborne particles are retrieved within the canister 10 such particles are filtered out by the filter means within the abrading device B which is exhausting air to the atmosphere from above the abrasive material retained within the canister 10. Thus the abrading cabinet device provides an improved facility for carrying out a blasting operation by enabling the operator to better view the work being abraded, and dust and debris in the system are prevented from entering the atmosphere about the cabinet. Such an arrangement also enables the cabinet in this system to be used at multiple locations within an enclosed shop without dispensing environmentally dangerous dust and air-laden particles into the atmosphere where adjacent workmen are performing their functions.

I claim:

1. In an abrasive blasting system including an abrading device having a housing containing a supply of abrasive material and having an outlet at the bottom thereof, a source of vacuum connected to the housing and applying a negative pressure to the upper surface layer of said abrasive material, a gun for directing abrasive material in the direction of a surface area to be abraded and having a passageway therethrough, a source of positive pressure air connected to one end of said gun passageway, a first conduit connected to the housing above said abrasive material for returning abrasive material and abrading debris to the housing, a second conduit having a first end portion connected to the housing outlet and a second end portion connected to said gun passageway downstream of the connection of said source of positive pressure to said gun, and means for causing abrasive material to flow toward the gun in said second conduit, an abrading cabinet device in which an abrasive blasting operation is performed on articles to be abraded, comprising:

(1) a cabinet housing having
  (a) a bottom,
  (b) a peripheral sidewall, and
  (c) a cover member to afford an enclosed inner blasting chamber, the cover member being movable to open the chamber for placing articles to be abraded in, and removing said articles from, the chamber;
(2) a base member for supporting the cabinet in upright position;
(3) a rack formed of spaced elements and supported in the chamber in spaced relation from the housing bottom, the spaced elements permitting spent abrasive and debris from a blasting operation to pass downwardly through said rack to the housing bottom;
(4) aperture means in the housing of a size to accommodate the source of positive pressure air and the second conduit so that each can be connected to the gun within the chamber;
(5) means for manipulating the gun from a position exteriorly of the cabinet housing;
(6) means for manipulating articles to be abraded within the chamber from a position exteriorly of the housing;
(7) a window of transparent material in the housing and positioned above the rack for viewing the inner blasting chamber;
(8) an exhaust outlet in the housing bottom below the rack, said exhaust outlet being adapted for connection with the first conduit to return spent abrasive and debris to the housing of the abrading device, the source of vacuum connected to the housing of the abrading device maintaining a negative pressure in the first conduit and in the chamber of the cabinet housing during a blasting operation;
(9) and means for providing the ingress of ambient air into the chamber of the cabinet housing at a position above the rack during a blasting operation to establish a continuing current of air flow downwardly through the rack and through the exhaust outlet in the housing bottom, the current of air continuously clearing the space in the chamber between the window and the rack of viewing-obscuring debris from the blasting operation by carrying said debris to the exhaust outlet.

2. An abrading cabinet device as specified in claim 1 in which the housing bottom is funnel-shaped and the exhaust outlet is at the lower end of said funnel-shaped bottom.

3. An abrading cabinet device as specified in claim 1 in which the means for providing the ingress of ambient air is an opening in the cabinet housing, and a shield member is provided spaced inwardly from the opening to prevent the egress of ricocheting abrasive and debris during a blasting operation.

4. An abrading cabinet device as specified in claim 1 in which the means for providing the ingress of ambient air includes a U-shaped passageway which opens into the blasting chamber.

5. An abrading cabinet device as specified in claim 4 in which a shield member is provided spaced inwardly from the passageway to prevent the egress of ricocheting abrasive and debris during a blasting operation.

6. An abrading cabinet device as specified in claim 5 in which vertically spaced baffle members are positioned between the shield member and the cabinet housing further to prevent the egress of ricocheting abrasive and debris during a blasting operation.

7. An abrading cabinet device as specified in claim 1 in which the cover member is swingably mounted on the peripheral sidewall, the cover member having a circumferentially extending edge portion which is provided with an elongated sealing member to provide a close sealing fit between the cover and the peripheral sidewall, and edge portion of the cover member having a circumferentially extending depending portion which is positioned within the chamber to shield the sealing member from abrasive during a blasting operation.

8. An abrading cabinet device as specified in claim 1 in which the cover member has a depending peripheral sidewall which abuts the sidewall of the cabinet housing to form therewith the blasting chamber, the means for manipulating the gun being formed in the depending sidewall and being spaced from the rack a sufficient distance so that articles in all locations on the rack can be subjected to a blasting operation.

* * * * *